US005361623A

United States Patent [19]

Wantz

[11] Patent Number: 5,361,623

[45] Date of Patent: Nov. 8, 1994

[54] DELIVERY SYSTEM FOR SMOKE DETECTOR TESTING SPRAY FORMULATION

[75] Inventor: James C. Wantz, Mesa, Ariz.

[73] Assignees: Leon Cooper; William H. Haines, both of Malibu, Calif.

[21] Appl. No.: 954,682

[22] Filed: Sep. 30, 1992

Related U.S. Application Data

[63] Continuation of Ser. No. 560,138, Jul. 30, 1990, abandoned.

[51] Int. Cl.[5] ..... G08B 29/00

[52] U.S. Cl. ..... 73/1 G

[58] Field of Search ..... 73/1 G, 865.9; 222/3, 222/4

[56] References Cited

U.S. PATENT DOCUMENTS

| | | | |
|---|---|---|---|
| 3,618,822 | 11/1971 | Hildenbrandt, Jr. | 222/3 |
| 3,693,401 | 9/1972 | Purt et al. | 73/1 G |
| 4,271,693 | 6/1981 | Bute | 73/1 G |
| 4,301,674 | 11/1981 | Haines et al. | 73/1 G |
| 4,462,244 | 7/1984 | Lee | 73/1 G |
| 5,060,503 | 10/1991 | Spohn et al. | 73/1 G |

*Primary Examiner*—Robert Raevis
*Attorney, Agent, or Firm*—Natan Epstein

[57] ABSTRACT

A system for controlled delivery of test formulation adapted for emulating the effects of combustion products to a smoke detector under test has a tube with a diameter between approximately one-half inch and three inches and a length of at least twelve inches, the tube being mounted in alignement with the spray nozzle of the aerosol dispenser.

14 Claims, 1 Drawing Sheet

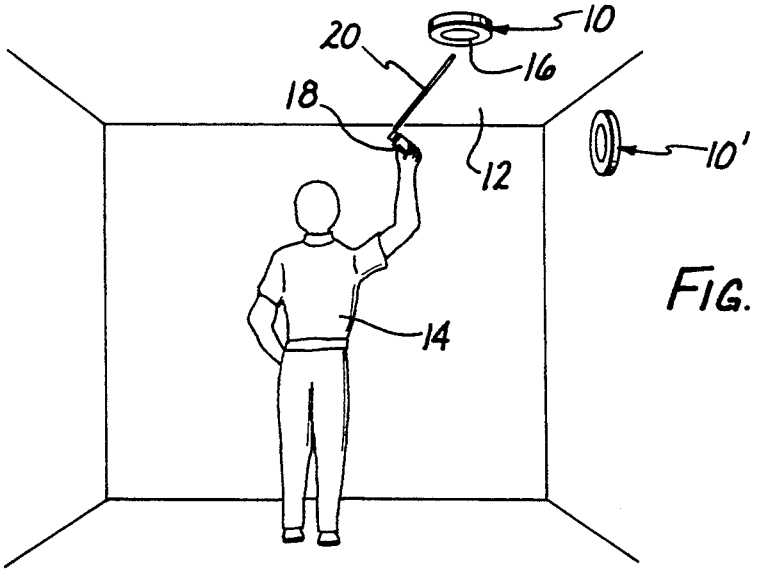
FIG. 1
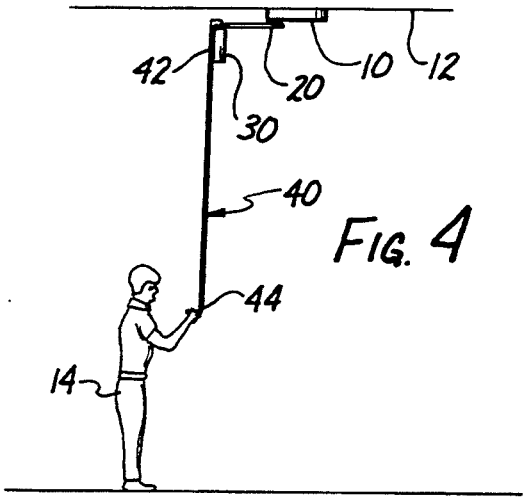
FIG. 4
FIG. 2
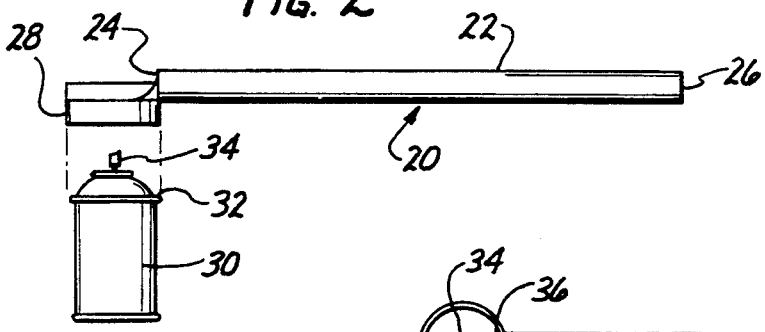
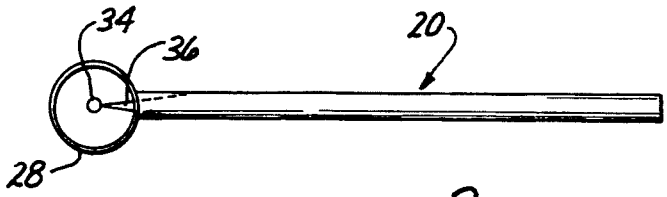
FIG. 3

DELIVERY SYSTEM FOR SMOKE DETECTOR TESTING SPRAY FORMULATION

This is a continuation of co-pending application Ser. No. 07/560,138 field on Jul. 30, 1990, now abandoned.

BACKGROUND OF THE INVENTION

1. Field of the Invention

The present invention relates generally to devices and materials for testing the proper operation of electronic smoke detectors and more particularly relates to a delivery system for more effectively delivering a test formulation adapted to simulate the effect of combustion products to the device under test.

2. State of the Prior Art

Smoke detectors are commonplace fixtures in public buildings and private dwellings to protect lives and reduce property damage by giving early warning of fire. Numerous lives are lost through smoke inhalation every year before the fire has spread to the rooms occupied by the victims. In a private home a properly functioning smoke detector can alert the home occupants to give them the time needed to safely exit the building. Fast response of the detector is of great importance since even one or two minutes may make the difference between a safe exit and loss of life in a typical home fire, due to the speed of propagation of the conflagration.

There are currently two basic types of smoke detectors. The ionization type senses changes in the electrical conductivity of the air in a chamber which is subject to radiation. The photoelectric type on the other hand senses light scattering in a detector chamber. Both devices respond to the presence of particulate matter or particles of combustion byproducts which, when present in great quantities, are visible as smoke. However, in the earliest stages of a fire, these combustion byproducts take the form of invisible aerosol, consisting of very fine particles suspended in air. It has been determined that such aerosols are generated at early stages of the fire, even before actual ignition, merely as a result of sufficient heating of combustible materials.

Detectors are typically provided with a "test" feature which is actuated by pressing a test button or pulling a switch mounted on the housing of the detector unit. Such "testing" however, is not a true operational test of the detector; it actually only verifies that power is supplied to the detector circuit and that the audible alarm does function. The test does not truly verify the responsiveness of the sensor element to the presence of smoke or combustion particles in the test chamber of the device. It is possible for a detector to respond as expected when the test button is pressed, while failing to respond to the presence of smoke. Smoke detectors of either type are susceptible to failure because the sensitivity of the electronic detector may deteriorate over time due to accumulation of dust, grease, corrosive fumes, moisture or other environmental contaminant. Aging of the electronic devices may contribute to such malfunctions.

For these reasons, it is desirable to provide means by which a true operational test of the smoke detector can be carried out in a convenient manner.

Operational testing of smoke detectors is described in U.S. Pat. No. 4,301,674 issued to these applicants. The Haines et al. '674 discloses a chemical formulation which, when discharged in aerosol form in the vicinity of a smoke detector, effectively emulates the presence of smoke particles. This earlier formulation is packaged in spray cans to allow easy, convenient and reliable operational testing of smoke detectors. Previous to the '674 patent, smoke detector testing was conducted either by actually generating smoke in the vicinity of the detector, or by enclosing the smoke detector in a housing to create an artificial environment into which was introduced an aerosol spray. The former approach was inconvenient and often dangerous while the latter was likewise inconvenient in that an enclosure had to be placed around the detector and furthermore, was less than a true operational test of the device in that the enclosure was often flooded with the trigger substance and consequently did not test the low level sensitivity of the device which is necessary to provide early warning of a fire.

Smoke detectors are usually mounted either on a ceiling or high up on a wall where hot combustion gases tend to accumulate. This location places the detectors out of easy reach for the individual of average height holding a spray can in his or her hand. Often it becomes necessary to use a ladder, step stool, or the like to get adequate access. Further, the quantity of spray delivered is left to the discretion of the user. While a small discharge will usually suffice, but because a small delay is usually inherent in the detector circuit users tend to continue spraying until the detector alarm goes off. Consequently, a considerable amount of the formulation is needlessly wasted, and builds up on the housing of the detector. Also, low cost aerosol dispensers discharge a substantial volume of coarse liquid particles along with the fine aerosol mist. For test purposes, it is the aerosol mist which is desirable and effective, while the coarse spray merely wets the detector.

What is needed therefore, is an aid for facilitating the delivery of the test formulation to a smoke detector mounted beyond easy arms length reach while at the same time eliminating or minimizing undesirable application of liquid particles which are ineffective in emulating a fire condition thereby to avoid unnecessary waste and unsightly deposits of oily materials on the detector housing.

SUMMARY OF THE INVENTION

A delivery system is provided for use with an aerosol dispenser for delivering a formulation adapted to emulate the effects of combustion products to an electronic smoke detector for verifying operation of the detector. The novel attachment comprises a tube having a diameter between approximately one-half inch and three inches and a length of at least twelve inches between an inlet end and an outlet end; and mounting means attached near the inlet end for supporting the tube to an aerosol spray dispenser with the proximal inlet opening in proximity with and aligned with a spray nozzle of the dispenser. The tube may be a cylindrical tube extending generally radially from the mounting ring, which is adapted to make a friction fit or a snap fit with the aerosol dispenser. The preferred dimensions of the delivery tube for general purpose testing of smoke detectors is a diameter of approximately one inch, and a length of at least eighteen inches between the inlet end opening and the outlet end opening.

With the novel delivery system, formulation adapted to emulate combustion products may be delivered to an electronic smoke detector having a smoke sensor, for verifying operation of the detector, by a method comprising the steps of placing the outlet opening of the delivery tube in proximity to the smoke sensor of the smoke detector; positioning the inlet opening in alignment with the spray nozzle of an aerosol dispenser containing the formulation; and spraying the formulation into the inlet opening of the delivery tube, so that aerosol of the formulation is directed to the smoke sensor while coarser spray droplets are substantially stopped from reaching the smoke sensor. The preferred formulation for delivery by this method is the formulation set forth above, and the method can be practiced with the novel delivery system of this invention.

These and other advantages of the present invention will be better understood by reference to the detailed description of the preferred embodiments below.

BRIEF DESCRIPTION OF THE DRAWINGS

FIG. 1 is a perspective view of a typical room with a ceiling mounted smoke detector, illustrating the delivery of the test formulation with the delivery system of this invention;

FIG. 2 is an elevational side view showing the delivery system being fitted to a typical aerosol spray can;

FIG. 3 is a top plan view of the delivery system fitted to the aerosol can of FIG. 2;

FIG. 4 shows use of the delivery system on a spray dispenser mounted on an extension pole.

DETAILED DESCRIPTION OF THE PREFERRED EMBODIMENTS

Turning now to the attached drawings, FIG. 1 illustrates a typical room having a smoke detector 10 mounted on a ceiling 12, and for illustration, a smoke detector 10' mounted on a wall. A user 14 standing on the floor of the room is shown in the process of delivering an aerosol 16 of a smoke detector test formulation contained in an aerosol spray dispenser 18, held in and actuated by the user's hand. The spray dispenser 18 is shown fitted with a spray delivery system 20, better seen in FIGS. 2 and 3 of the drawings. The aerosol cloud can reach a few feet from dispenser 18 to reach a ceiling mounted or wall mounted smoke detector up to a height of e.g. 10 feet.

Difficulties with this approach are that (a) a substantial amount of product must be sprayed in the general direction of the smoke detector 10 when the dispenser cannot be brought into immediate proximity to the detector's sensing chamber (b) excess product is unavoidably deposited on parts of the smoke detector other than the sensing chamber itself and (c) in a drafty environment, it may actually be impossible to trigger the detector 10 with any reasonable amount of spray as the aerosol will be carried away before reaching the smoke detector 10.

It has been found that users all too frequently deliver grossly excessive amounts of the formulation to smoke detectors. This results in part from the fact that many smoke detectors have an inherent delay in their response to the presence of the trigger substance. The tendency for the user is to continue spraying until the smoke detector alarm is activated, rather than deliver a short spray and then wait for the response. Another tendency is for the user to spray too close to the detector. Either tendency results in gross misuse of the product. The active ingredient in the test formulation, when delivered to a surface in small amounts in aerosol form, tends to evaporate with very little or no residue. If applied in grossly negligent fashion however, the material can build up on surfaces of the detector housing, attracting dust and causing esthetically unsightly deposits. No damage has been reported to the proper operation of smoke detectors after millions of tests conducted with the prior formulation of these applicants. Nevertheless, the possibility of diminished sensitivity by the detector must be considered if excessive amounts of this test formulation are repeatedly applied in a grossly negligently manner.

In order to avoid these and other shortcomings, the aerosol dispenser 18 is fitted with the novel delivery system 20 shown in the drawings.

Turning to FIGS. 2 and 3, the delivery system 20 consists, in this presently preferred example, of a straight cylindrical tube 22 open at an inlet end 24 and an outlet end 26. The tube 22 is of cylindrical and uniform cross section between opposite ends 24, 26 and has a smooth internal tube surface. A mounting ring 28 is attached to the tube 22 near the inlet end 24. The tube 22, as best seen in FIG. 3 extends radially from the mounting ring 28. Preferably, the tube 22 and mounting ring 28 are formed of injection molded plastic. The ring 28 has an inside diameter sized to make a friction fit or snap fit with the top rim 32 of an aerosol spray dispenser 30, which may be of a conventional type, such as are in widespread use for application of many consumer products. The dispenser 30 is a metallic can pressurized by a propellant and containing the formulation to be dispensed. Finger operated dispensing valve 34 at the top center of the dispenser 30 ejects a spray of the dispenser contents when pressed. The propellant gasifies very quickly, dispersing the liquid formulation into fine droplets in a directional spray 36 suggested in dotted lining in FIG. 3. The spray discharge 36 typically includes a true aerosol of the formulation as well as substantial quantities of small droplets of various sizes which do not however constitute a true aerosol. In an aerosol, particulate material is relatively stable and homogeneously suspended in a gaseous medium, in this case air. The non-aerosol particles, by contrast, are affected by gravity to a greater extent and tend to settle out of the spray more quickly. These coarser liquid droplets tend to follow a ballistic path when ejected from the spray nozzle 34, in contrast to a more fluidic, homogeneous cloud-like displacement of the aerosol.

For purposes of operational testing of smoke detectors, it is the aerosol portion of the spray discharge which is most desirable and effective for activating the smoke detector sensor and most closely emulates the effect of combustion products generated at early stages of a conflagration. On the other hand, it is the coarser fluid particles which are mainly responsible for buildup of messy deposits on the smoke detector. Dust and dirt adhere to the sticky fluid making the device aesthetically unsightly. Therefore, it is desirable to minimize the quantity of test formulation delivered to the detector.

This objective is achieved by use of the delivery system 20, which allows highly selective delivery of the formulation. The selectivity is two-fold. Firstly, the tube 22 operates to separate the coarser, non-aerosol component of the spray 36 while allowing substantially unimpeded flow of true aerosol through the tube to the smoke detector 10. Secondly, the target zone on the detector 10 is greatly restricted because the outlet end 26 of the tube 22 can be brought into close proximity and even directly against the opening into the sensing chamber of the smoke detector 10, thereby sparing adjacent surfaces and components from being coated with the spray formulation.

The optimum length for the delivery tube 22 for general purpose testing of smoke detectors has been found to be 18 inches. Useful results can be obtained with a tube length as short as 12 inches, however. The length of the tube may be as long as 10 feet, for use in industrial or commercial environments where smoke detectors are installed at considerable heights above a factory or warehouse floor, for example. Because of its fluid-like flow, true aerosol will pass through such a long tube without undue loss of effectiveness, whereas virtually all non-aerosol droplets will be deflected by gravity onto the interior tube wall before reaching the outlet end. The optimal width of the tube 22 is 1 inch in diameter. This diameter centers the inlet opening 24 on the discharge nozzle 34 when mounted to the top of the dispenser 30 as shown in the drawings, since the discharge hole in the nozzle 34 is approximately one half inch above the rim 32 in most commonly used aerosol spray cans. However, the diameter of the tube 22 may be as small as one-half inch, or as large as three inches. A diameter lesser than one half inch will tend to cause substantial back-pressure and hinder the flow of the spray 36 through the tube. A diameter greater than three inches on the other hand becomes unnecessarily unwieldy, especially for greater lengths of the tube 22. A larger diameter tube will be off-center relative to the discharge opening in the nozzle 34 if mounted as shown, which offset however is not critical to the proper operation of the delivery system 20.

The delivery system is useful not only for reaching ceiling or wall mounted smoke detectors but is also useful in testing detectors mounted in various crawl spaces and other hard to reach places. For example, computer rooms have a subfloor through which pass the many cables and conductors interconnecting the various components of the computer system. Smoke detectors are often installed in the subfloor for detection of possible electrical fires in that area. The testing of such detectors may require the user to crawl into the subfloor space to reach the detector with the aerosol spray. The delivery system 20 of this invention can greatly facilitate this task. The user can simply reach into the subfloor and bring the outlet end 26 of the tube 22 into proximity with the smoke detector and briefly press the discharge nozzle 34 in order to complete the test. Because of the fluidic character of the aerosol mist, the tube 22 of the delivery system 20 need not be straight. For certain applications, it may be desirable to curve or bend the tube 22 so as to facilitate reach into awkward spaces.

Another advantage of the delivery system 20 is that smoke detector testing can be carried out in areas with air turbulence, which would otherwise deflect the aerosol spray from reaching the smoke detector. The end of the delivery tube 22 can placed against the opening to the sensing element of the detector so that even under conditions of severe air turbulence, delivery of the product into the sensing chamber of the detector can be assured.

Still another benefit derived from the delivery system 20 is illustrated in FIG. 4. An extension pole 40 has an actuating mechanism 44 at the proximal end held by the user 14 for remotely actuating the dispenser 30 mounted to the distal end 42 by means of a linkage extending along the pole 40. When such an extension device 40 is used for bringing the dispenser 30 into proximity to a ceiling mounted smoke detector 10, it is often difficult for the user 14 to see in what direction the spray nozzle of the dispenser 30 is pointing. This difficulty often results unnecessary waste of the test formulation before the detector 10 is activated. This problem is largely overcome by fitting the dispenser 30 with the delivery system 20 which is plainly visible at heights of 20 or 30 feet so that the user 14 can easily aim the discharge of the dispenser 30 at the desired target.

The delivery system 20 not only makes for a cleaner and more effective test procedure but also results in economy of the test formulation since the spray discharge can be positively and selectively delivered to the sensing chamber of the detector, making unnecessary longer duration sprays in the general direction of the detector before actuation is accomplished.

While preferred embodiments of the invention have been described and illustrated for purposes of clarity and example, it must be understood that many changes, substitutions and modifications will become apparent to those possessed of ordinary skill in the art without thereby departing from the scope and spirit of the invention which is defined by the following claims.

What is claimed is:

1. In combination an aerosol dispenser of the type having a pressurized container and a finger actuated spray nozzle on the container for delivering a directed aerosol spray discharge of a formulation adapted to emulate combustion products to an electronic smoke detector for verifying operation of the detector, said attachment comprising:

a tube having length of at least twelve inches an inlet end and an outlet end; and mounting means for supporting said tube to the container independently of said spray nozzle but in axial alignment with the direction of the spray discharge from the nozzle and with said inlet end in sufficient proximity to the spray nozzle of the dispenser for receiving substantially all of the spray discharge of said nozzle;

said tube having a diameter and a length selected to admit generally unimpeded flow of the aerosol to the detector for verifying operation of the detector while coarse droplets ejected by the spray nozzle are collected on an interior surface of said tube thereby to minimize wetting of the detector with said formulation.

2. The combination of claim 1 wherein said tube is a cylindrical tube.

3. The combination of claim 1 wherein said mounting means is a ring adapted to make a friction fit with said dispenser.

4. The combination of claim 3 wherein said tube extends generally radially from said ring.

5. The combination of claim 1 wherein said inlet end is supported in spaced relation to said nozzle.

6. The combination of claim 1 wherein said diameter is between approximately one-half inch and three inches.

7. The combination of claim 1 wherein said length is at least twelve inches.

8. The combination of claim 1 wherein said tube is straight and of uniform diameter.

9. An attachment for use with an aerosol dispenser for delivering a formulation adapted to emulate combustion products to an electronic smoke detector for verifying operation of the detector, said attachment comprising:

a cylindrical tube of continuous cross-section having a diameter of approximately one inch and a length of at least eighteen inches between an inlet end opening and an outlet end opening; and a mounting ring near said inlet end opening of said tube, said tube extending radially from said ring;

said tube and said mounting ring being integrally molded of plastic material, said mounting ring adapted to make a friction fit with the top of said dispenser for supporting said tube in alignment with a spray nozzle of the dispenser.

10. A method for delivering a formulation adapted to emulate combustion products to an electronic smoke detector having a smoke sensor, for verifying operation of the detector comprising the steps of:

providing a tube at least one half inch in diameter having an inlet opening and an outlet opening and a length at least twelve inches:

placing said outlet opening in proximity to the smoke sensor of the smoke detector;

positioning said inlet opening in alignment with the spray nozzle of an aerosol dispenser containing said formulation for receiving substantially all of the spray discharge of said nozzle; and spraying said formulation into said inlet opening;

whereby aerosol of said formulation is directed to the smoke sensor while coarser spray droplets are substantially stopped from reaching the smoke sensor.

11. The method of claim 10 wherein said tube is provided with mounting means adapted to engage the dispenser and said positioning step comprises the step of engaging said mounting means to said dispenser.

12. An attachment for use with an aerosol dispenser of the type having a pressurized container and a finger actuated spray nozzle on the container for delivering a directed aerosol spray discharge of a formulation adapted to emulate combustion products to an electronic smoke detector for verifying operation of the detector, said attachment comprising:

a tube of substantially uniform cross-section having a diameter between approximately one-half inch and three inches and a length of at least twelve inches between an inlet end and an outlet end;

a ring fixed to said tube and adapted to make a friction fit with the container of the aerosol spray dispenser for supporting said inlet end in alignment with the directed discharge but away from contact with the spray nozzle of the dispenser.

13. The attachment of claim 12 wherein said tube extends generally radially from said ring.

14. A method for delivering an aerosol of a formulation adapted to simulate smoke particulates to a smoke detector under test with an aerosol dispenser of the type having a finger actuated spray nozzle for delivering a directed aerosol spray discharge of the formulation for verifying operation of the detector, said method comprising the steps of:

positioning a tube of at least twelve inches in length between the spray nozzle and the detector with an open inlet end of the tube in axial alignment with the directed discharge and unattached to but in sufficient proximity to the nozzle for receiving substantially all of the discharge from said nozzle, and an open outlet end of the tube in proximity to the detector; and actuating said nozzle;

said tube having a diameter selected to permit substantially unimpeded passage of the aerosol to the detector for verifying operation of the detector while coarse droplets ejected by the spray nozzle are collected on an interior surface of said tube thereby to minimize wetting of the detector with said formulation.

* * * * *